United States Patent [19]

Pickett, Jr.

[11] 4,059,752

[45] Nov. 22, 1977

[54] TROPHY LAMP

[76] Inventor: James Henry Pickett, Jr., 1362 Otis Place, NW., Washington, D.C. 20010

[21] Appl. No.: 647,879

[22] Filed: Jan. 9, 1976

[51] Int. Cl.[2] ..... F21V 33/00; A47B 17/04

[52] U.S. Cl. ..... 362/98; 362/253

[58] Field of Search ..... 240/2 SL, 2 R, 2 AD, 240/10 R; 312/204; 248/466

[56] References Cited

U.S. PATENT DOCUMENTS

| | | | |
|---|---|---|---|
| 1,411,660 | 4/1922 | Howson | 312/204 |
| 1,693,620 | 12/1928 | Silverman | 240/2 SL |
| 2,469,072 | 5/1949 | Lerman | 240/2 AD |
| 2,544,415 | 3/1951 | Busam | 312/204 X |
| 2,574,164 | 11/1951 | Baay | 240/2 AD |
| 2,734,998 | 2/1956 | Norwood | 240/10 R X |
| 2,821,621 | 1/1958 | Allunario | 240/2 AD X |
| 2,991,577 | 7/1961 | Bellocchio | 248/466 UX |
| 3,598,986 | 8/1971 | Love | 240/2 AD |
| D. 75,032 | 5/1928 | Zweig | 240/2 SL UX |
| D. 95,571 | 5/1935 | Andrews | 240/2 SL UX |

*Primary Examiner*—Donald A. Griffin
*Attorney, Agent, or Firm*—George H. Mitchell, Jr.

[57] ABSTRACT

An ornamental trophy consists of a base upon which are mounted a three dimensional trophy and one or more receptacles for displaying a memento of the trophy such as a certificate, or a photograph; a light source, such as an ornamental lamp, is also supported by the base in a position so as to illuminate the trophy and certificates, and the base may include a sliding drawer for mementos relating to the trophy.

6 Claims, 3 Drawing Figures

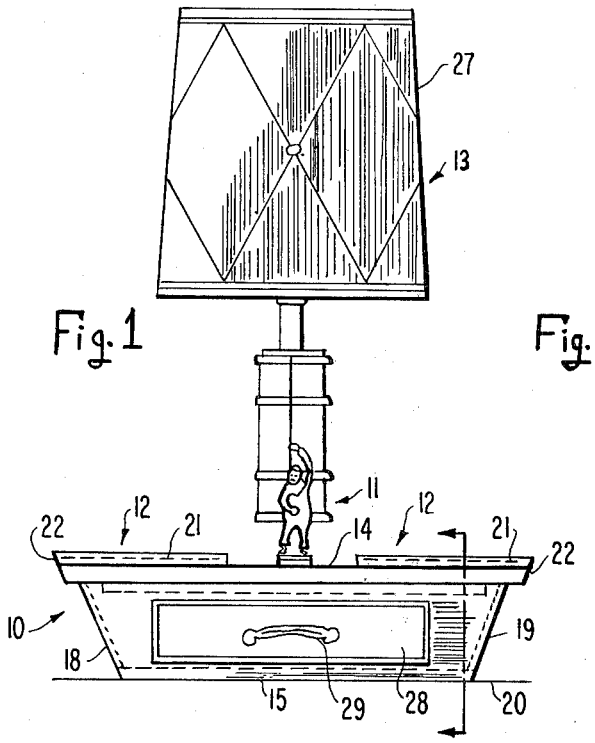
Fig. 1
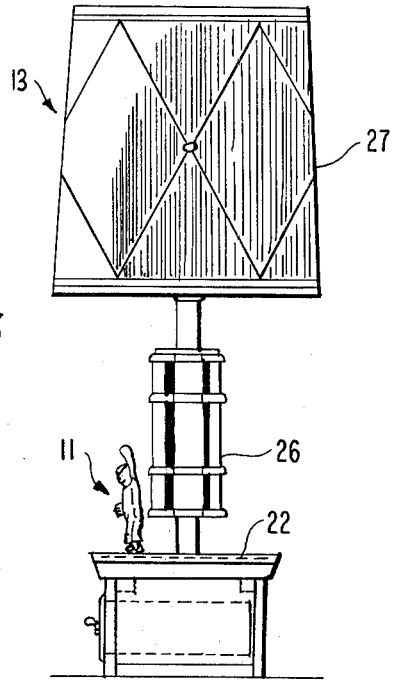
Fig. 3
Fig. 2
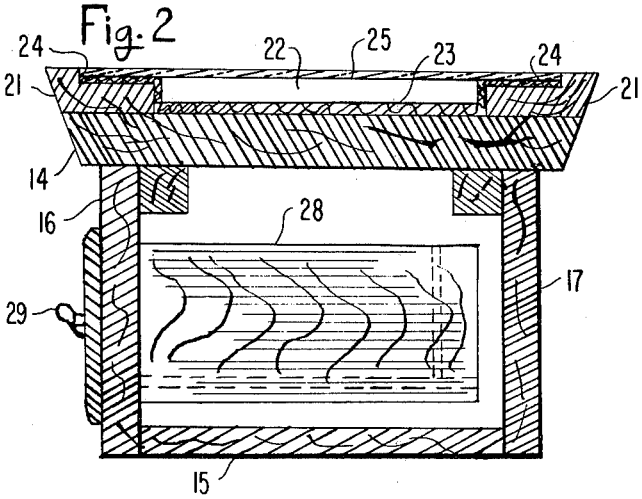

TROPHY LAMP

This invention relates to ornamental articles and more particularly to trophies of the type customarily awarded for achievement in the field of sports, although not specifically limited thereto.

Awards of this type commonly consist of a three-dimensional representation symbolic of the field to which the award relates and is often accompanied by a certificate setting forth the circumstances, such as the contest, or event, in which the award was given, together with the dates, names of contestants and the organization presenting the award.

The three-dimensional trophy may comprise a statuette representative of a typical contestant in the event, or may be representative of the sport itself as, for example, a baseball bat, or a football. The trophy is usually mounted on a base, and may be provided with a plate bearing a simple inscription bearing the name and/or date of the event and may include the contestant's name.

A scroll, or other written memento of the occasion may also accompany the award of the trophy. The scroll, or other written commendation can, of course, be framed and displayed on a wall the usual way; whereas the trophy may be placed on a shelf, mantelpiece, table or kept in a cabinet.

Nevertheless, there is usually no convenient way in which to display both trophy and written material associated with the trophy in conjunction with each other.

Therefore, it is one object of the present invention to provide an article by means of which a three-dimensional trophy and a memento in sheet form may be displayed together in a logical and convenient manner.

It is also an object of the invention to provide an article which not only provides for displaying a three-dimensional trophy and a memento in sheet form in association with each other, but also serves to illuminate these objects as well as provide a general source of illumination for the area surrounding the display.

A further object of the invention is to provide an article of the above-mentioned character which may also include means, such as a sliding drawer, which can be used to keep other objects or souvenirs, associated with the award of the trophy itself. In this way, most of the physical articles connected with an event may be collected and retained together in one place instead of becoming lost or mislaid as a result of the usual casual storage in separate unrelated locations.

Still another object of the invention is to provide an article which may serve as an ornamental piece of furniture in the form of a decorative lamp, or table.

Others objects and advantages will be evident to those skilled in the art after reading the following specification in connection with the annexed drawings in which:

FIG. 1 is a front elevation of a preferred from of trophy lamp constructed in accordance with the teachings of the present invention;

FIG. 2 is a cross-section on the line 2—2 of FIG. 1; and

FIG. 3 is a side elevation of the trophy lamp of FIG. 1.

In the drawings, the numeral 10 indicates generally a base, upon which there may be mounted in a generally central area, a three-dimensional trophy, indicated generally by numeral 11, flanked by one or more receptacles for mementos in sheet form, indicated generally by numeral 12, above which there is a source of illumination, such as an ornamental electric lamp indicated generally by numeral 13.

In the form shown, the base consists of a generally rectangular cabinet, having a flat top 14 and bottom 15 joined by vertical front and back walls 16 and 17 and downwardly converging end walls 18 and 19 made of wood, plastic or other suitable materials. While the base is shown as being placed on a horizontal surface, indicated by numeral 20, such as a table, or shelf, it is obvious that the base itself could be provided with legs so as to serve as a table and that other configurations could be used within the scope of this invention.

The three-dimensional trophy 11 shown in the drawings consists of a statuette of a person executing an exercise in karate and indicates an award in that art. The statuette is mounted firmly on the top wall 14, preferably in a central location. It should also be obvious that there can be an endless variety of statuettes, representative of any type of sport, which could be used and, that three-dimensional trophies representative of activities outside the field of sports could also be employed.

The receptacles 12, placed on both sides of the trophy comprise rectangular areas suitable for enclosing photographs, or written commendations, relating to the award of the trophy, and could be formed as recesses in the upper surface of the top 14. However, as shown, these areas are defined by elongated framing strips 21 and 22 which are nailed, or glued to the surface 14. For protection of the papers, or other materials, placed in the receptacles they may be lined with a decorative material 23, such as felt or velour and the upper inside margins of the strips 21 and 22 may be recessed at 24 (as shown in FIG. 2) to removably receive a protective cover 25 of transparent sheet material such as glass or plastic.

While the source of illumination 13 could comprise nearly any form of lighting device mounted on the base 10, designed to project light downwardly on the trophy 11 and the receptacles 12, a preferred form consists of an electric lamp of conventional design, having a vertical pedestal 26 mounted on the top surface 14 to support light bulb socket (not shown) at its upper end surrounded by an ornamental tubular lampshade 27. The wiring and switch for the lamp are not shown, but it will be apparent that sufficient light from the lamp will be deflected downwardly to illuminate the trophy 11, and the sheets within the receptacles 12, as well as to provide additional light in the area where the trophy is located.

The front wall 16 of the base may also be provided with an opening within which a sliding drawer 28, having a handle 29, may be received to provide a storage compartment for other mementos relating to the award of the trophy 11.

Having disclosed one form of invention for collecting various articles associated with each other and with an award for safekeeping and display it will be understood that various modifications and improvements may be made which would come within the scope of the annexed claims.

I claim:

1. A trophy lamp comprising a base, a three-dimensional trophy supported fixedly upon said base, a receptacle fixedly supported by said base for displaying a sheet commemorative of the award of said trophy comprising a picture frame having a removable transparent cover, a source of illumination comprising an ornamental pedestal lamp mounted behind said trophy supported by said base and positioned to illuminate said trophy and sheet, a drawer to receive mementos relating to said trophy, and means for slidably receiving said drawer within said base.

2. The invention defined in claim 1, wherein said source of illumination also includes a reflector means for an electric light in said socket.

3. The invention defined in claim 1, wherein said source of illumination comprises a tubular lampshade.

4. The invention defined in claim 1, wherein said base is provided with a flat upper surface upon which said trophy and receptacle are mounted.

5. The invention defined in claim 1, wherein said base is provided with a flat upper surface upon which said trophy is mounted, said surface having a recessed area defining said receptacle, said receptacle including a transparent cover.

6. The invention defined in claim 5, wherein said surface is substantially horizontal, said surface being provided with a pair of recessed areas spaced from each other defining a pair of said receptacles, said trophy projecting upwardly above said pair of receptacles.

* * * * *